US011807493B1

(12) United States Patent
Koenig et al.

(10) Patent No.: US 11,807,493 B1
(45) Date of Patent: Nov. 7, 2023

(54) RETROFITTED HOIST MACHINE

(71) Applicant: Otis Elevator Company, Farmington, CT (US)

(72) Inventors: Christopher H. Koenig, Granby, CT (US); Barry G. Blackaby, Simsbury, CT (US); Daniel B. Davis, Middlefield, CT (US); Gregory M. O'Seep, Simsbury, CT (US); John Eschenbrenner, Canton, CT (US); Jesse R. Richter, West Hartford, CT (US); Gary P. Mendrala, West Springfield, MA (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 1226 days.

(21) Appl. No.: 16/176,945

(22) Filed: Oct. 31, 2018

Related U.S. Application Data

(63) Continuation of application No. 16/160,213, filed on Oct. 15, 2018.

(51) Int. Cl.

| | |
|---|---|
| ***B66B 1/32*** | (2006.01) |
| ***B66B 19/00*** | (2006.01) |
| ***B66B 5/02*** | (2006.01) |
| ***B66B 1/36*** | (2006.01) |
| ***B66D 5/02*** | (2006.01) |

(52) U.S. Cl.
CPC ..... *B66B 1/32* (2013.01); *B66B 1/36* (2013.01); *B66B 5/02* (2013.01); *B66B 19/007* (2013.01); *B66D 5/02* (2013.01)

(58) Field of Classification Search
CPC .... B66B 1/32; B66B 1/36; B66B 5/02; B66B 5/04; B66B 19/007; B66D 5/02
See application file for complete search history.

(56) References Cited

U.S. PATENT DOCUMENTS

| | | | | |
|---|---|---|---|---|
| 5,156,239 | A | 10/1992 | Ericson et al. | |
| 5,202,539 | A | 4/1993 | Lamb | |
| 5,709,285 | A | 1/1998 | Sokalski et al. | |
| 5,944,150 | A * | 8/1999 | Hikari | F16D 65/097 188/161 |
| 7,527,127 | B2 | 5/2009 | Osterman et al. | |
| 7,819,229 | B2 | 10/2010 | Hanninen et al. | |
| 7,866,633 | B2 | 1/2011 | Weiss et al. | |

(Continued)

FOREIGN PATENT DOCUMENTS

| | | |
|---|---|---|
| EP | 0545369 B1 | 12/1992 |
| EP | 1922281 B1 | 9/2011 |

OTHER PUBLICATIONS

Replacement Brake Units—General Information—Elevator Equipment. Elevator Equipment Limited. Retrieved on Aug. 20, 2018 from http://www.elevatorequipment.co.uk/liftequipment/brakeunitreplacements/replacementbrakeunitsgeneralinformation. 4 Pages.

*Primary Examiner* — Minh Truong
(74) *Attorney, Agent, or Firm* — CANTOR COLBURN LLP

(57) ABSTRACT

Disclosed is a method of retrofitting a legacy hoist machine including: attaching a primary brake assembly to an end surface of a machine shaft, and configuring a controller to: control the primary brake assembly to provide service braking; and control a brake drum assembly as a secondary brake assembly to thereby apply emergency braking.

6 Claims, 5 Drawing Sheets

(56) References Cited

U.S. PATENT DOCUMENTS

| | | | | |
|---|---|---|---|---|
| 8,602,170 | B2 * | 12/2013 | Fischer | B66B 11/043 187/391 |
| 8,752,262 | B2 | 6/2014 | Davis et al. | |
| 9,309,091 | B2 | 4/2016 | Husmann | |
| 9,463,956 | B2 * | 10/2016 | Lähteenmäki | B66D 5/30 |
| 10,005,644 | B2 * | 6/2018 | Vincent | H02K 11/20 |
| 2009/0127949 | A1 * | 5/2009 | Zhang | B66B 11/0438 310/77 |
| 2010/0101896 | A1 * | 4/2010 | Ueda | B66B 5/0031 187/254 |
| 2012/0153754 | A1 * | 6/2012 | Vincent | B66D 5/14 310/77 |
| 2015/0083527 | A1 | 3/2015 | Liu | |
| 2017/0023319 | A1 | 8/2017 | Studer et al. | |
| 2018/0141781 | A1 | 5/2018 | Davis, III et al. | |
| 2021/0101777 | A1 * | 4/2021 | Millett | B66B 5/0037 |

* cited by examiner

RETROFITTED HOIST MACHINE

CROSS REFERENCE TO RELATED APPLICATIONS

This application is a continuation of and claims the benefit of an earlier filing date from U.S. Non-provisional application Ser. No. 16/160,213 filed on Oct. 15, 2018, the entire disclosure of which is incorporated herein by reference.

BACKGROUND

The embodiments herein relate to a gearless elevator hoisting and more specifically to a system and method for providing a retrofitted hoist machine.

Legacy gearless elevator hoisting machines may be unequipped to provide braking requirements according to government regulations. It may be desirable for an updated design having a configuration that is capable of being retrofitted to legacy machines.

SUMMARY

Disclosed is a gearless braking hoist machine for an elevator system, comprising a machine shaft and a primary brake assembly disposed at an end surface of the machine shaft, and a secondary brake assembly engaging a brake drum, and a controller that controls the primary brake assembly to effect service braking and controls the secondary brake assembly to effect emergency braking.

In addition to one or more of the above features or elements, or as an alternate the primary brake assembly is a disk brake assembly.

In addition to one or more of the above features or elements, or as an alternate the secondary brake assembly is axially adjacent to a drive sheave.

In addition to one or more of the above features or elements, or as an alternate the controller controls the secondary brake assembly to engage in response to detecting uncontrolled elevator car motion (UCM) and/or detecting ascending elevator car over-speed (ACO).

In addition to one or more of the above features or elements, or as an alternate the secondary brake assembly provides a braking force that is greater than a braking force provided by the primary brake assembly.

In addition to one or more of the above features or elements, or as an alternate the controller controls the secondary brake assembly to arrest a load more quickly and over a shorter distance than the primary brake assembly.

Further disclosed is a method of retrofitting a legacy hoist machine comprising: attaching a primary brake assembly to an end surface of a machine shaft, and configuring a controller to: control the primary brake assembly to provide service braking; and control a brake drum assembly as a secondary brake assembly to thereby apply emergency braking.

In addition to one or more of the above features or elements, or as an alternate the method includes attaching the primary brake assembly to the machine shaft with one or more fasteners.

In addition to one or more of the above features or elements, or as an alternate the method includes supporting the primary brake assembly on either a common bedplate with the hoist machine or on a hoist machine support.

Further disclosed is a method of effecting braking with a hoist machine, the machine comprising a primary brake assembly disposed at an axial end surface of the machine shaft and a secondary brake assembly operationally engaging a machine drum, and a controller for controlling the primary brake assembly and secondary brake assembly, the method comprising the controller controlling the primary brake assembly to effect service braking and controlling the secondary brake assembly to effect emergency braking.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
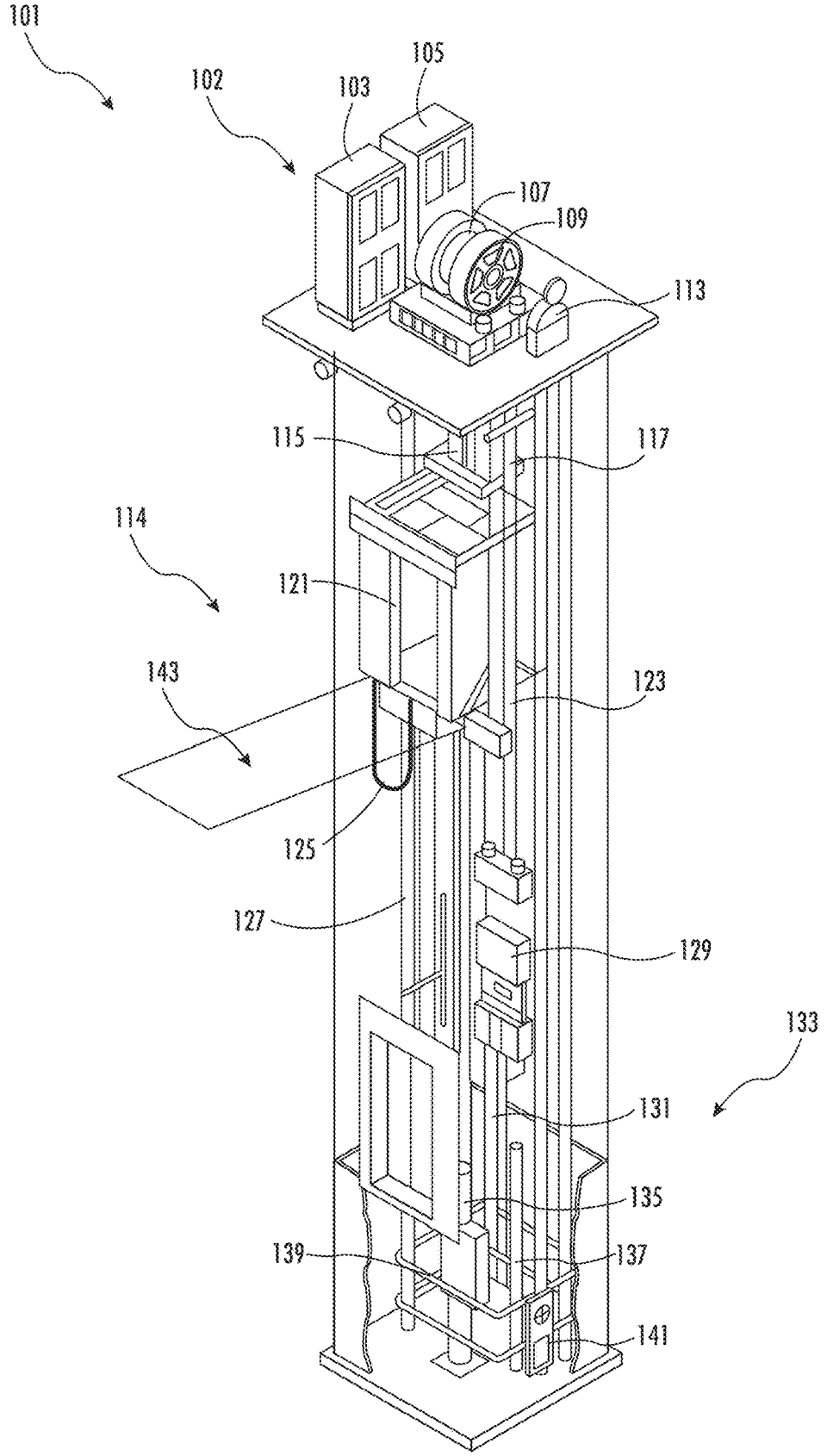
FIG. 1 is a schematic illustration of an elevator system that may employ various embodiments of the present disclosure.

FIG. 1 is a perspective view of an elevator system 101 including a upper utility area (which may be a control room) 102 including an elevator control system (controller) 103, a brake and drive system 105, a gearless machine (or machine) 107, a primary velocity transducer 109 and a governor 113.

Below the upper or overhead utility area 102 in the elevator hoistway 114, the system 101 includes, hoisting ropes 115, roller guides 117, an elevator car 121, load-weighting transducers 123, a traveling cable 125, an elevator rail 127 and a counterweight 129. In a lower utility area 131 the system includes and provides access to compensation ropes 133, a car buffer 135, a counterweight buffer 137, a compensation sheave 139 and a governor tension sheave 141. The counterweight 129 is configured to balance a load of the elevator car 121 and is configured to facilitate movement of the elevator car 121 concurrently and in an opposite direction with respect to the counterweight 129 within an elevator hoistway 114 and along the elevator rail 127.

The gearless machine 101 is configured to control movement between the elevator car 121 and the counterweight 129. The controller 103 is located, as shown, in a controller room 102 of the elevator hoistway 114 and is configured to control the operation of the elevator system 101, and particularly the elevator car 121. For example, the controller 103 may provide drive signals to the machine 101 to control the acceleration, deceleration, leveling, stopping, etc. of the elevator car 121. When moving up or down within the elevator hoistway 114 along elevator rail 127, the elevator car 114 may stop at one or more landings 143 as controlled by the controller 103. Although shown in a controller room 121, those of skill in the art will appreciate that the controller 103 can be located and/or configured in other locations or positions within the elevator system 101. In one embodiment, the controller may be located remotely or in the cloud.

FIG. 1 is merely a non-limiting example presented for illustrative and explanatory purposes. As such element numbers in the remaining figures in this document will not be directly referring to this example.

Figure 2:
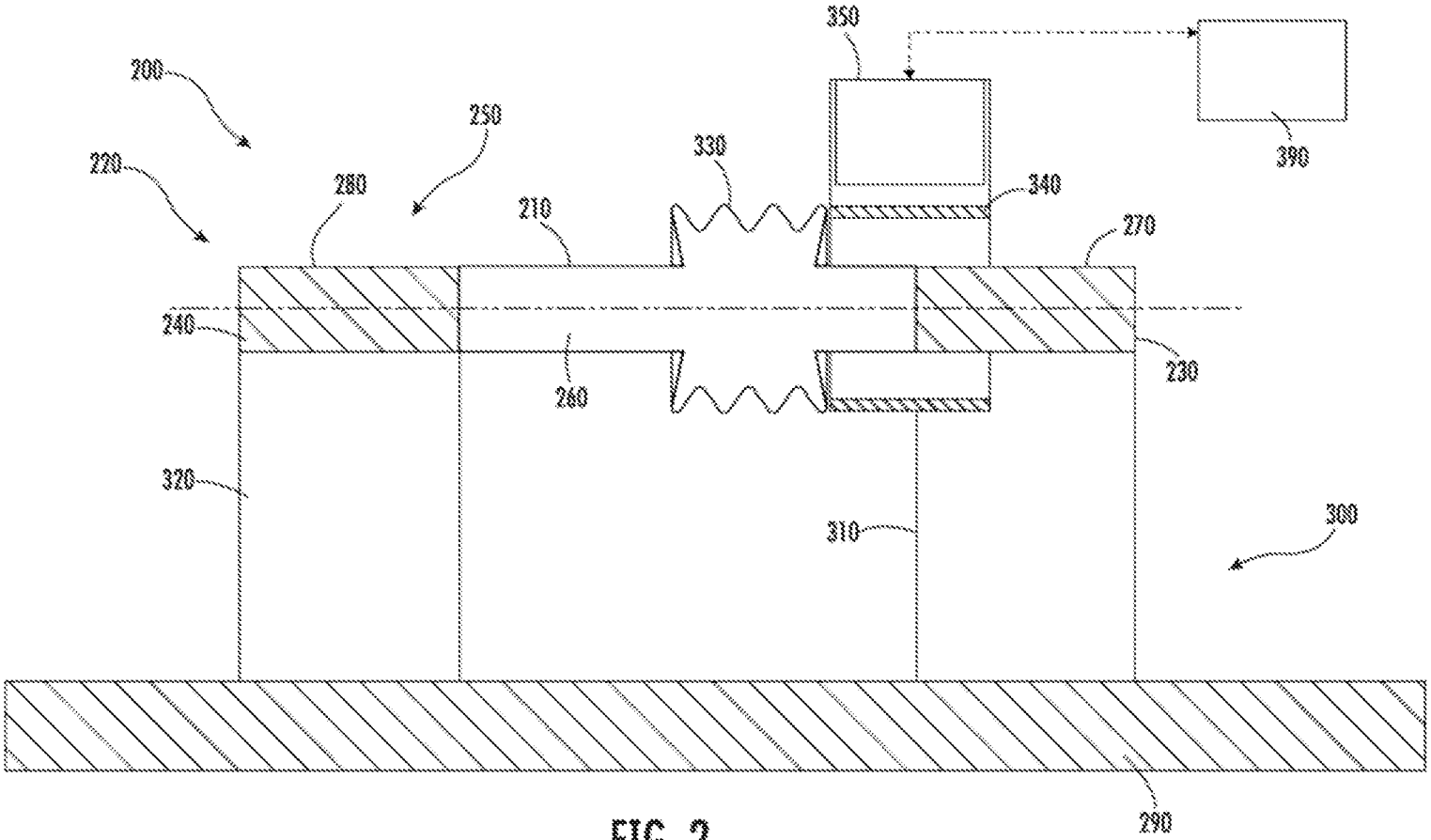
FIG. 2 (Prior Art)
FIG. 2 illustrates a legacy hoist machine assembly.

Turning to FIG. 2, a legacy gearless hoist machine (hereinafter the "legacy machine") 200 is illustrated. The legacy machine 200 may include various implements including a machine (or primary) shaft 210 having a plurality of ends 220 including an axial proximate end 230 and an axial distal end 240. The legacy machine may include a plurality of bearings 250 that rotationally support the respective plurality of ends of the shaft to thereby provide rotation of the machine shaft 210 about a rotation axis 260. The plurality of bearings 250 include a proximate bearing 270 and a distal bearing 280. The plurality of bearings 250 support the legacy machine 200 above a bedplate 290, or similar structural platform.

A rigid connection between the legacy machine 200 and the bedplate 290 effects structural integrity and maintains a positional relationship between the plurality of elements that comprise the legacy machine 200. The rigid connection may be achieved by providing a plurality of supports 300, including a proximate support 310 and a distal support 320, between the bedplate 290 and respective plurality of bearings 250. Axially between the plurality of bearings 250 is a drive sheave 330 and a brake drum 340 which are integrally connected to the shaft so that stopping the brake drum stops the sheave 330. The brake drum 340 is acted upon by a drum brake assembly 350 illustrated schematically in FIG. 3.

Figure 3:
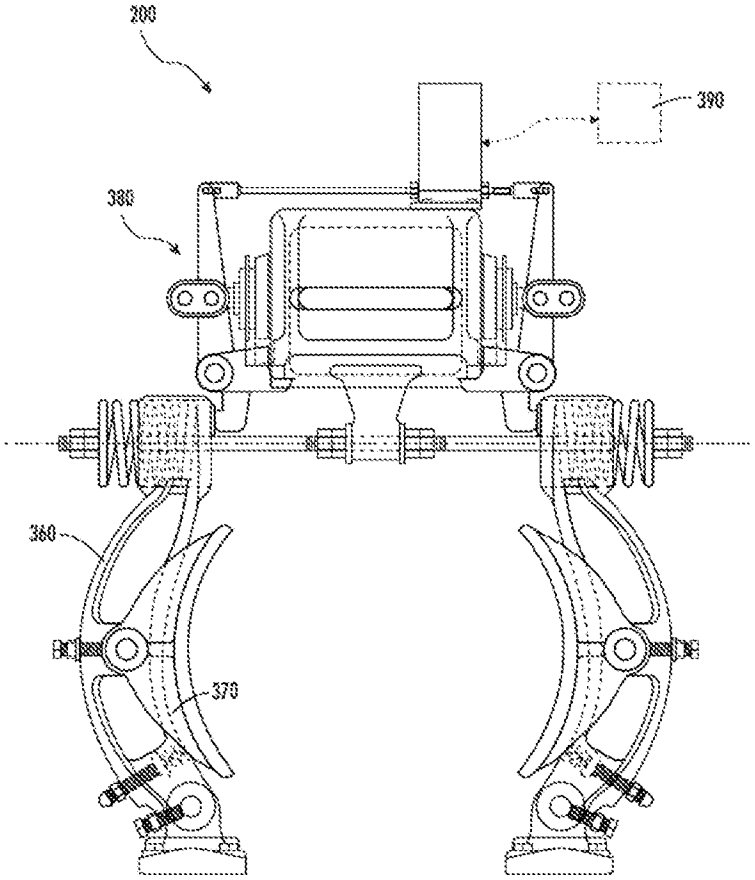
FIG. 3 (Prior Art)
FIG. 3 illustrates a legacy drum brake assembly.
Figure 4:
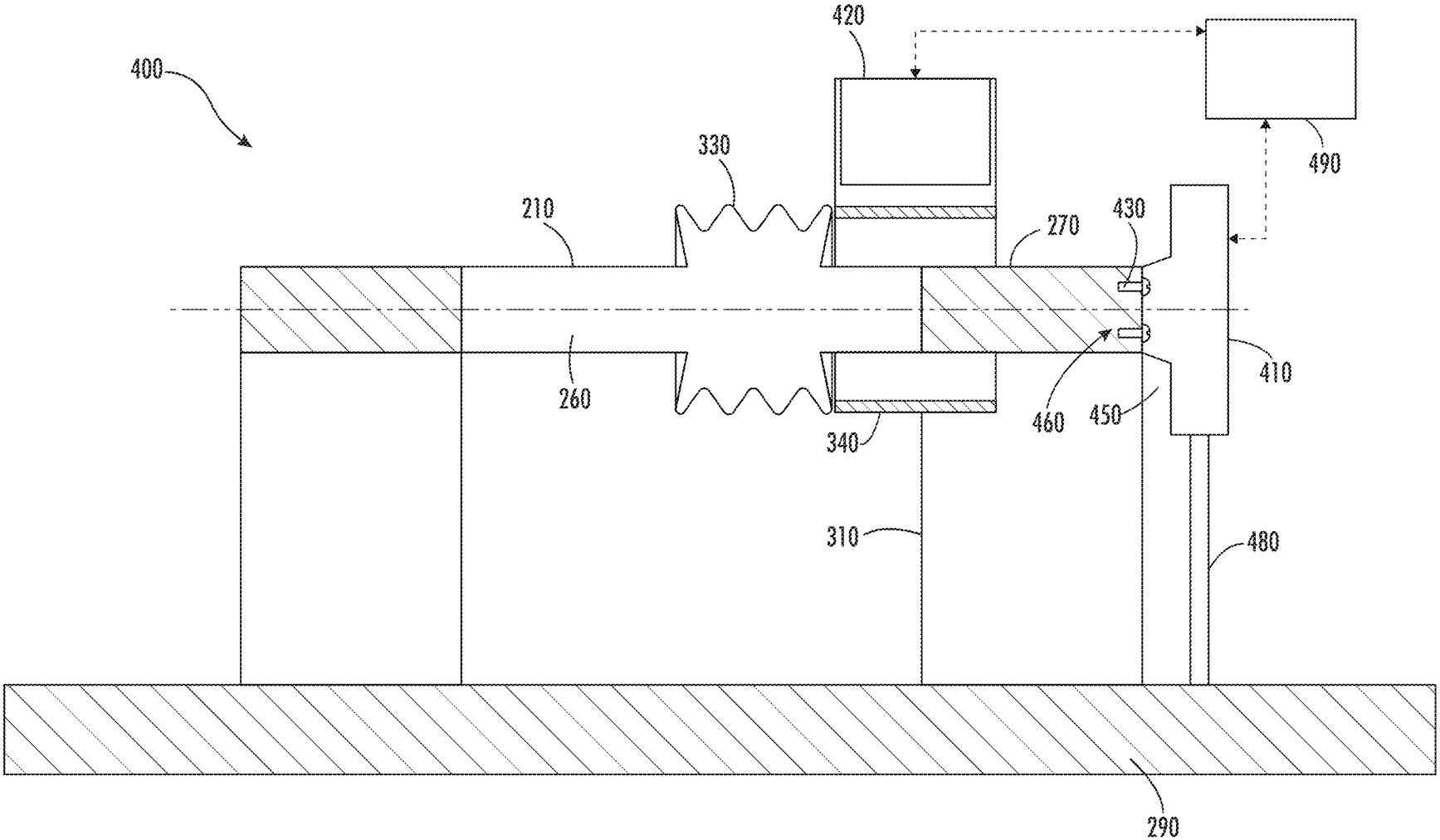
FIG. 4 illustrates a hoist machine assembly according to one or more disclosed embodiments.

Turning to FIG. 3, the drum brake assembly 350 includes one or more external brake arms 360 to apply braking through a respective one or more brake shoes 370. The brake shoes may be equipped with frictional material on drum engaging surfaces so that controlled motion of the brake arms effect frictional forces against the drum to stop the drum. There are two brake arms 360 and respective shoes 370 in FIG. 3, which may be electrically actuated by an electromagnetic solenoid 380. The solenoid 380 may be operationally controlled by a controller 390. The controller 390 may effect braking by actuating the drum brake assembly 350 according to a set of protocols applicable to providing normal braking, otherwise known as service braking or machine braking. In a drum braking system such as that illustrated in FIG. 3, wherein a single solenoid controls both sets of brake arms and shoes, the brake assembly may become a single point of failure for braking capabilities of the machine. For this reason certain government regulations affecting elevator safety may indicate a preference for redundant (additional) brakes to protect passengers from a single point failure of the brake assemblies. For certain hoist machine designs, such additional brakes may be built into the hoist machine using independent arms or additional disk brake assemblies. For legacy machines such as those illustrated in FIG. 2, it may be desired for an additional brake to act directly upon the drive sheave, the brake drum, the hoist ropes, the compensation ropes or the counterweight. The location of the drum brake assembly in FIG. 2, however, may limit the possible locations to install an additional brake. Turning to FIG. 4, a retrofitted hoist machine 400 ("retrofitted machine") is provided according to a disclosed embodiment. The retrofitted machine 400 may be obtained by modifying the legacy machine 200. Features of the retrofitted machine 400 that are the same as those in the legacy machine 200, to the extent addressed hereinafter, will have the same reference identifiers. The retrofitted machine 400 may include a primary (or service) brake assembly 410 and a secondary (or emergency) brake assembly 420. At a proximate end surface 430 of the machine shaft 210, which rotates in the proximate bearing 270, the retrofitted machine 400 may include the primary (or machine) brake assembly 410 connected thereto by a stub shaft 450. The stub shaft 450 may be connected to the machine shaft 210 by securing features 460 such as connector bolts connected to threaded blind-holes in the machine shaft 210. The primary brake assembly 410 may be for example a disk brake assembly. The primary brake assembly 410 may be supported against the bedplate 290 by a support frame 480 so that rotational members such as braking disks in the primary brake assembly rotate on the rotational axis 260. The support frame 480 also functions as a torque arm. The support frame 480 may optionally be secured to the proximate support 310 for the machine 400. In the retrofitted machine 400 the drum brake assembly 420 may be the retained and repurposed drum brake assembly 350 for the legacy machine 200. Though, the drum brake assembly 420 in the retrofitted machine 400 maybe modified as required to effect emergency/backup/redundancy braking. With this configuration the secondary brake assembly 420 may act directly upon the drive sheave 330 which carries the hoist ropes (not shown).

A controller 490 is provided which differs from the controller 390 in the legacy machine 200 as disclosed herein. The controller 490 in the retrofitted machine 400 may be configured to effect routines for service braking with the primary brake assembly 410 acting against the proximate end surface 430 of the machine shaft. In addition the controller 490 may be configured to effect routines for emergency braking with the secondary brake assembly 420 acting against the brake drum 340 connected to the drive sheave 330. For example the controller 490 in the retrofitted machine 400 may be configured to control the secondary brake assembly 420 to engage in response to detecting uncontrolled elevator motion (UCM) and/or detecting ascending elevator car over-speed (ACO). Due to the above features of the brakes and the controller, during a UCM or ACO event, the controller controls the secondary brake assembly 420 to arrest a load more quickly and over a shorter distance than the primary brake assembly 410.

As indicated above the primary brake assembly 410 and the secondary brake assembly 420 in the retrofitted machine 400 are configured to provide different braking capabilities. Table A provides an example of braking capabilities for the primary brake assembly 410 and the secondary brake assembly 420 in the retrofitted machine 400, according to an embodiment. In table A, the following definitions apply

TABLE A

| braking design requirements for the primary brake assembly 410 and the secondary brake assembly 420 in the retrofitted machine 400 | |
|---|---|
| Requirements for engaging the primary brake assembly | Requirements for engaging the secondary brake assembly |
| Typical conditions in which the primary brake successfully engages:<br>Condition: within a percentage (e.g., 0-125%) of maximum (max) DL, and hold car in place as needed.<br>ETS conditions in which the primary brake successfully engages:<br>Combination of<br>(i) within a percentage range (e.g., 0-100% ) of max DL AND ONE OF<br>(ii) when an UP speed of the car is detected as being greater than an allowable speed at a top section of the hoistway AND<br>(iii) when a DOWN speed of the car is detected as being greater than allowable at a bottom section of the hoistway<br>REQUIREMENT: Engage to bring speed to an allowable range. | ACO conditions in which the secondary brake must successfully engage:<br>Combination of each of<br>(i) within a percentage range (e.g., 0-125%) of max DL,<br>(ii) traveling upward, AND<br>(iii) detects ACO, that is, speed that is greater than allowed.<br>REQUIREMENT: Engage to bring speed to an allowable range.<br>UCM conditions in which the secondary brake must successfully engage:<br>Combination of (i) unloaded car, (ii) car is stopped, and (iii) UCM detected in an upward direction<br>Or<br>Combination of (iv) within a percentage range (e.g. 0-125%) of max DL, (v) car is stopped, and (vi) UCM is detected in downward direction.<br>REQUIREMENT: Engage and provide a stop distance of less than or equal to a threshold distance (e.g., 1220 millimeters). |

Definitions: ACO: Ascending elevator car over-speed
DL: Duty Load/Max Predetermined Allowable Load for elevator car,
ETS: Emergency Terminal Slowdown (effected at opposing terminal ends of hoistway,
UCM: uncontrolled car motion It is understood by those of ordinary skill in the art that Table A is indicative of a non-limiting example of a relative difference between the primary and secondary brake assemblies and that different values may be used in other implementations and embodiments.

Figure 5:
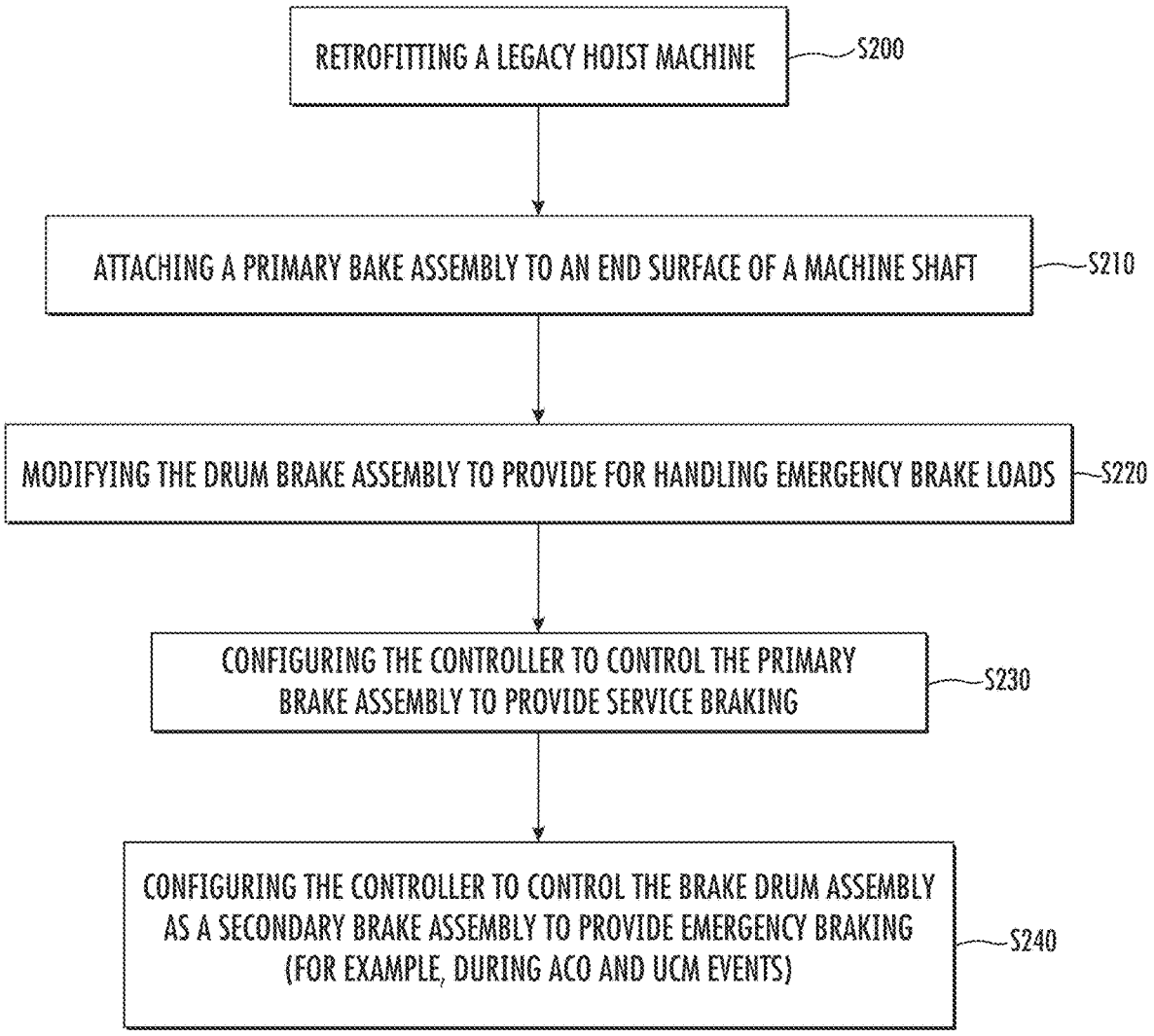
FIG. 5 illustrates a retrofitting process according to one or more disclosed embodiments.

Turning to FIG. 5, illustrated therein is a method S200 of retrofitting the legacy hoist machine has been disclosed in this document. The method generally includes step S210 of attaching the primary brake assembly to the end surface of the machine shaft. Step 220 includes modifying the drum brake assembly to provide for handling emergency brake loads. Step S230 includes configuring the controller to control the primary brake assembly to provide service braking. Step S240 includes configuring the controller to control the brake drum assembly as a secondary brake assembly to provide emergency braking.

The above disclosed embodiments provide for adding redundant braking to a gearless elevator machine. An existing drum brake assembly may be retained and modified as needed for use as the secondary (emergency/backup/redundant) brake. A brake assembly 410 may be attached to the proximate end surface 430 of the machine shaft 210 to function as the primary (or service or machine) brake assembly. The primary brake assembly 410 and secondary brake assembly 420 are controlled differently and have different physical characteristics as provided herein.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A method of retrofitting a legacy hoist machine, the legacy hoist machine including:

a bedplate;

a machine shaft extending from an axial first end to an axial second end, the machine shaft having a first end surface;

a first bearing supporting the first end of the machine shaft, and a first support extending from the bedplate to the first bearing;

a second bearing supporting the second end of the machine shaft, and a second support extending from the bedplate to the second bearing;

a drive sheave axially between the first and second bearings of the machine shaft;

a brake drum axially between the drive sheave and the first end of the machine shaft and integrally connected to the machine shaft;

a legacy brake assembly that operates as the only brake assembly for the legacy hoist machine prior to attaching an additional brake assembly, the legacy brake assembly being axially adjacent to the drive sheave and configured to engage the brake drum, wherein the legacy brake assembly includes one or more external brake arms configured to apply braking through a respective one or more brake shoes and a solenoid configured to control the one or more brake arms, wherein prior to attaching the additional brake assembly, the legacy brake assembly is controlled as a primary brake assembly, the method including:

attaching the additional brake assembly to the first end surface of the machine shaft, by fasteners that extend into the first end surface of the machine shaft, so that the first bearing is between the additional brake assembly and the brake drum, and configuring a controller to:

control the legacy brake drum as a secondary brake assembly rather than the primary brake assembly to thereby apply emergency braking, control the additional brake assembly as the primary brake assembly to provide service braking, and wherein the additional brake assembly includes a stub shaft with a first end connected to the first end surface of the machine shaft by the fasteners, a disk brake assembly connected a second end of the stub shaft, and a torque limiting support frame supporting the disk brake assembly between one of the bedplate and the first support.

2. The method of claim 1, wherein:

the controller is configured to control the legacy brake assembly to engage in response to detecting one or more of uncontrolled elevator motion (UCM) and ascending elevator car over-speed (ACO).

3. The method of claim 2, wherein:

the legacy brake assembly provides braking force that is greater than a braking force provided by the additional brake assembly.

4. The method of claim 3, wherein:

the controller controls the legacy brake assembly to arrest a load more quickly and over a shorter distance than the additional brake assembly.

5. The method of claim 1, including:

supporting the additional brake assembly on either a common bedplate with the hoist machine or on a hoist machine support.

6. A gearless braking hoist machine for an elevator system configured according to the method of claim 1.

* * * * *